United States Patent [19]

Giordano

[11] Patent Number: 4,540,960

[45] Date of Patent: Sep. 10, 1985

[54] MONOCHROMATIC RADIO FREQUENCY ACCELERATING CAVITY

[75] Inventor: Salvatore Giordano, Port Jefferson, N.Y.

[73] Assignee: The United States of America as represented by the United States Department of Energy, Washington, D.C.

[21] Appl. No.: 578,406

[22] Filed: Feb. 9, 1984

[51] Int. Cl.[3] ..... H01P 1/16; H01P 7/04; H01P 7/06

[52] U.S. Cl. ..... 333/228; 333/81 A; 333/81 B; 333/211; 333/251; 333/222

[58] Field of Search ..... 333/222–228, 333/206–212, 240, 248, 81 R, 81 A, 81 B, 251, 22 R, 22 F; 315/4, 5, 5.41, 5.42, 5.51, 5.52

[56] References Cited

U.S. PATENT DOCUMENTS

| | | | |
|---|---|---|---|
| 2,593,095 | 4/1952 | Brehm | 333/228 |
| 2,877,434 | 3/1959 | Farr et al. | 333/81 B X |
| 3,354,307 | 11/1967 | Holloway et al. . | |
| 3,496,497 | 2/1970 | Conning | 333/208 X |
| 3,544,923 | 12/1970 | Williams | 333/22 F |
| 3,560,694 | 2/1971 | White | 219/10.55 |
| 3,914,714 | 10/1975 | Johnson | 333/22 F |
| 4,017,760 | 4/1977 | Benoit et al. | 333/248 X |

OTHER PUBLICATIONS

Giordano–"A Monochromatic Radio Frequency Accelerator Cavity", 1983 Particle Accelerator Conference, Santa Fe, NM, 3/20–3/23 1983; 3 pages.

*Primary Examiner*—Marvin L. Nussbaum
*Attorney, Agent, or Firm*—Vale P. Myles; Paul A. Gottlieb; Judson R. Hightower

[57] ABSTRACT

A radio frequency resonant cavity having a fundamental resonant frequency and characterized by being free of spurious modes. A plurality of spaced electrically conductive bars are arranged in a generally cylindrical array within the cavity to define a chamber between the bars and an outer solid cylindrically shaped wall of the cavity. A first and second plurality of mode perturbing rods are mounted in two groups at determined random locations to extend radially and axially into the cavity thereby to perturb spurious modes and cause their fields to extend through passageways between the bars and into the chamber. At least one body of lossy material is disposed within the chamber to damp all spurious modes that do extend into the chamber thereby enabling the cavity to operate free of undesired spurious modes.

12 Claims, 8 Drawing Figures

MONOCHROMATIC RADIO FREQUENCY ACCELERATING CAVITY

The U.S. Government has rights in this invention pursuant to Contract Number DE-AC02-76CH00016, between the U.S. Department of Energy and Associated Universities Inc.

This invention relates to radio frequency resonant cavities that are useful as filters, impedance matching devices, accelerating devices, and other applications wherein electromagnetic energy is transported and, more particularly, it relates to a novel resonance cavity construction and configuration that allows the cavity to support a desired fundamental resonant frequency while being free of undesired spurious resonances or modes. The use of radio frequency resonant cavities for the kinds of applications indicated above is generally well known. Normally, for any of these applications it is desirable to design or select a cavity that supports a resonant at a selected fundamental frequency while being as free as possible of spurious modes or harmonics. Generally speaking, however, due to the normal structural features of resonant cavities they have an infinite number of resonances or harmonics. To suitably adapt such a cavity for a desired application, the user typically inserts probes or loops into the cavity in an effort to selectively damp or appropriately move given individual offending modes so that they do not destroy or undesirably diminish the desirable useful effect of the fundamental resonance of the cavity. Because any given cavity has an infinite number of modes in addition to its fundamental resonant frequency, it is always difficult, and sometimes virtually impossible, to selectively eliminate the undesired modes by using the conventional method of inserting probes or loops into the cavity.

In addition to the well known method of damping undesirable modes by using selectively placed probes and loops in a cavity, designers of resonant cavities for given applications usually attempt to first anticipate which spurious modes will likely cause significant difficulties in a desired application, then they attempt to design a configuration of the cavity to suitably attenuate those certain undesirable spurious modes. An example of such an approach is shown in U.S. Pat. No. 3,560,694, which issued Feb. 2, 1971 and discloses a multi-mode cavity that is used for applying microwaves to treat moving webs. The cavity is designed and constructed to include specific mode-damping means that effectively suppress or attenuate undesired classes of modes so that those modes are neither supported nor excited by the cavity. The specific design includes a lossy mode-damping element, such as a sheet of rubber loaded with lossy powders of iron, carbon, or ferrites, which is mounted at a joint between sections of the cavity in order to heavily attenuate any modes that may be present within the cavity and that produce currents that tend to flow across that joint. In addition, to the application of lossy material in the joint between sections of the cavity, the length and width of the cavity is configured to support desired fundamental frequencies while making it difficult to excite undesirable modes of oscillation within the cavity.

Although cavity designers are aware of such prior art methods for attenuating certain classes of undesired modes, it is frequently impossible to determine in advance which modes will cause trouble in a particular desired application of a radio frequency resonance cavity. Consequently, the usual design practice is to select a generally suitable cavity configuration for a given application, then place the cavity in operation and attempt to ascertain which particular modes are causing problems. After those problem modes are indentified the designer or operating engineer selectively applies probes, loops, or lossy material to the cavity in order to move or sufficiently damp each of the undesired modes to enable the cavity to suitably perform its intended function. Such prior art design and construction methods are particularly inefficient because they approach the problem of attenuating undesired modes by attempting to individually identify and damp each problem mode separately, or at best, they attempt to identify and eliminate selected narrow classes of spurious modes in a cavity.

It would be most desirable to avoid the necessity of resorting to such inefficient selective identification and spurious mode damping techniques. That objective would be accomplished if resonance cavities could be designed and constructed to support resonance at a single desired fundamental frequency while being substantially free of undesired spurious resonances.

OBJECTS OF THE INVENTION

It is a primary object of the invention to provide a radio frequency resonance cavity that overcomes or avoids the foregoing disadvantages of known prior art cavities.

An additional object of the invention is to provide a resonance cavity that has a single fundamental resonant frequency and that is essentially free of spurious modes.

Yet another object of the invention is to provide a radio frequency resonant cavity that affords the foregoing objectives while being economical to construct and efficient to operate.

Still another object of the invention is to provide a RF resonance cavity that can be placed directly in operation to afford a desired single fundamental resonance within the cavity, free of undesired spurious modes, without requiring the use of known prior art methods for further tuning the cavity with moveable probes or loops in order to selectively attentuate or move undesired spurious modes in the cavity.

Additional objects and advantages of the invention will be apparent to those skilled in the art from the description of it presented herein, considered in connection with the accompanying drawings.

SUMMARY OF THE INVENTION

In one preferred embodiment of the invention an RF resonance cavity is constructed with a solid, electrically conductive outer wall in combination with an electrically conductive, slotted inner wall that is spaced from the outer wall to define a chamber. Lossy material is positioned within the chamber to damp spurious modes that extend through the slots in the inner wall into the chamber. A plurality of probes are disposed at random locations around the inner slotted wall and on one end wall of the cavity to suitably damp any remaining spurious modes that may be produced within the cavity. The outer and inner walls of the cavity are spaced coaxially by predetermined distances from a hollow resonant stem mounted on one end wall of the cavity. The spacing of the walls is determined to be effective to help enable the cavity to support only a desired fundamental resonant frequency within the cavity. Thus, with the lossy material and the plurality of probes being effective to eliminate or substantially attenuate all spurious modes that might otherwise exist in the cavity, it operates at the desired fundamental resonant frequency without requiring further tuning adjustment or modification.

BRIEF DESCRIPTIONS OF THE DRAWINGS

Figure 1:
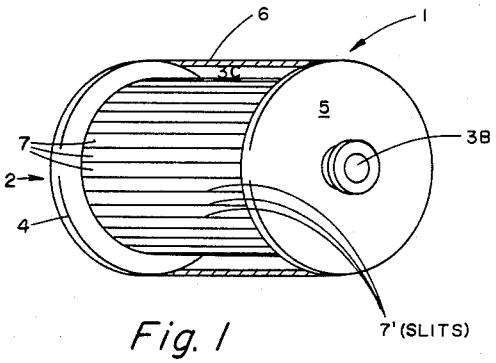
FIG. 1 is an isometric view of a radio frequency resonance cavity constructed according to the invention for use in a charged particle, accelerator or storage ring. The cavity is illustrated with a portion of its outer sidewall removed to reveal a slotted inner wall that constitutes a characterizing feature of the invention.
Figure 3:
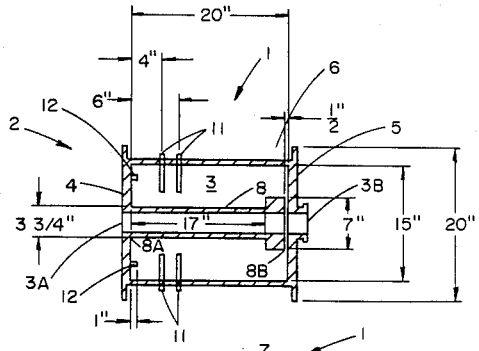

FIG. 3 is also a schematic side plan view, in cross section along a vertical diameter of the cavity illustrated in FIG. 1, depicting a plurality of radially disposed additional probes for perturbing undesired resonances within the cavity, and also showing optimum size relationships for components of a preferred embodiment of the cavity that is suitable for operation at a predetermined fundamental resonant frequency.

Figure 4:
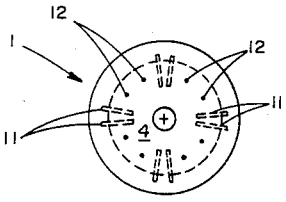

FIG. 4 is a plan view, partly in phantom, showing one end of the cavity depicted in FIG. 3 and illustrating all of the radially disposed, spurious mode perturbing rods used in this preferred embodiment of the invention.

Figure 5:
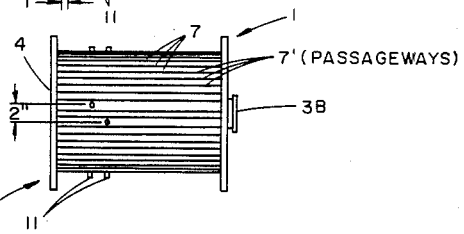

FIG. 5 is a side plan view of the cavity shown in FIGS. 1 through 4, further illustrating the arrangement of the spurious mode perturbing rods that project radially inward from the slotted wall of the cavity.

Figure 6:
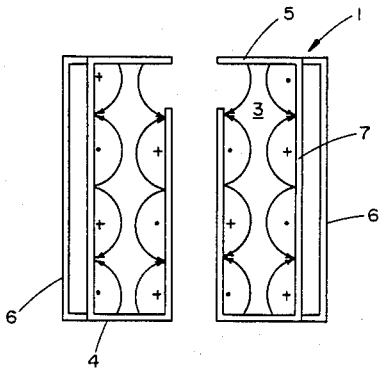

FIG. 6 is a schematic illustration of a cavity such as that shown in FIGS. 1–5, depicting the general configuration of electric and magnetic fields of unwanted modes that exist within the slotted walls of such a cavity, when it is in operation.

Figure 7:
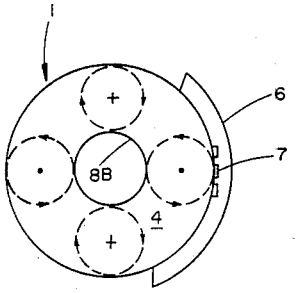

FIG. 7 is a schematic plan view of one end wall of a cavity, such as that shown in FIG. 1, illustrating with dashed lines and arrow symbols the general electric and magnetic field configurations that would be present on the end wall, when the cavity is operated.

Figure 8:
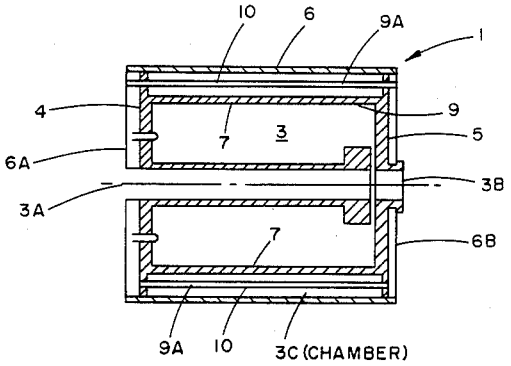

FIG. 8 is a schematic plan view in cross section along a vertical diameter of a resonance cavity, which is somewhat similar to that illustrated in FIG. 1, but is modified to illustrate an embodiment wherein the slits in the generally cylindrical slotted side walls of the cavity are extended into the end walls of the cavity. Also, the solid outer wall of the cavity is extended over the slotted end walls to define a hermetic seal around the exterior of all of the slotted walls of the cavity.

BRIEF DESCRIPTION OF THE PREFERRED EMBODIMENTS

As mentioned above, a novel cavity constructed according to the invention can be applied to a wide variety of different uses, including the various referenced applications related to particle beam line accelerators and storage rings. To describe the characteristic features of the invention, there is illustrated and described herein a radio frequency resonance cavity that is particularly adapted for use in a charged particle accelerator or particle beam storage ring. More particularly, in order to explain appropriate dimensions and relationships for a given preferred embodiment of the cavity of the invention, the embodiment described herein has an accelerating $TM_{o1o}$ mode of 90 megahurtz (MHz). Those skilled in the art will recognize that the teachings of the disclosure can be readily adapted to construct other suitably monochromatic, i.e. single fundamental resonant frequency, cavities for producing alternative desired accelerating $TM_{o1o}$ modes. Such alternative cavity dimensions can be determined by simply multiplying the dimensions set forth for the preferred embodiment described in the present disclosure by the quotient resulting from dividing 90 MHz by the desired $Tm_{o1o}$ mode frequency. Thus, if the new desired $TM_{o1o}$ mode is 180 MHz all of the cavity dimensions for the embodiment described herein should be multiplied by 90/180, or 0.5 in constructing a suitable radio frequency cavity for that application according to the present invention.

As shown in FIGS. 1 through 5, the radio frequency resonance cavity 1 of the preferred embodiment of the invention described herein has wall means, (generally designated by the numeral 2) that define a resonant cavity 3 (best seen in FIGS. 2 & 3), which has a conventional suitable inlet aperture 3A and outlet aperture 3B. The wall means 2 includes first and second generally circular end walls 4 and 5 that each include suitable wall means defining, respectively, the inlet aperture 3A and the outlet aperture 3B, through and coaxial with their centers. Also included in the wall means 2 is a generally cylindrically shaped continuous outer wall 6 that is formed of a suitable electrically conductive metal, such as copper or other conventional equivalent. Each of the axially spaced ends of the outer wall 6 are connected, respectively, to one of the end walls 4 and 5 adjacent to the peripheries thereof, in order to form a hermetically sealed joint therewith. In this form of the invention the generally cylindrically outer wall 6 is welded to the peripheries of both of the end walls 4 and 5, but other suitable connecting means may be used in alternative embodiments of the invention.

The wall means 2 further include a plurality of metal bars 7 that are arranged in a generally cylindrical array with their opposite ends each, respectively, spaced from the immediately adjacent bars in the array, and each secured to one of the end walls 4 and 5, as shown. The cylindrical array of bars 7 is disposed in relation to the end walls 4 and 5 so that the respective opposite ends of the bars 7 are secured at predetermined radial distances from the respective centers of the end walls, to position the bars between those centers and the circumference of the end walls, as shown in the drawings. The particular predetermined relationships for the disposition of the array of bars 7 in this preferred embodiment of the invention will be further explained in detail below. At this point it should be noted that the bars 7 serve to define the sidewall of the resonant cavity 3 as well as further defining the inner wall of a chamber 3C that extends around a predetermined portion of the resonant cavity 3. The bars 7 of wall means 2 are arranged to define passageways 7' through the inner side of the chamber 3C for enabling spurious modes to extend from the cavity 3 into the chamber 3C. In this embodiment, the passageways 7' comprise slits that are defined by the respective adjacent sides of bars 7. The slits each extend substantially the entire length of the inner side of the chamber 3C, so that they are each disposed parallel to the longitudinal axis of the cavity 3, as that axis extends between the inlet aperture 3A and the outlet aperture 3B of the cavity.

Each of the slits 7′ is made substantially equal to one another in width and is further made so each slit 7′ is about one-sixteenth of the width of the unslit portion of one of the bars forming the inner side of the chamber 3C adjacent to the slits. In particular, as more fully explained below, for this embodiment of the invention where each of the bars 7 is approximately 1 inch in width, the respective bars are positioned so that the slits 7′ between them is made about one-sixteenth inch wide. In alternative embodiments of the invention where other sizes of bars and correspondingly wider slits are utilized, it shoud be recognized that this relationship of one to sixteen in the widths of the slits relative to the width of adjacent bars is maintained, in order to properly practice the invention.

Figure 2:
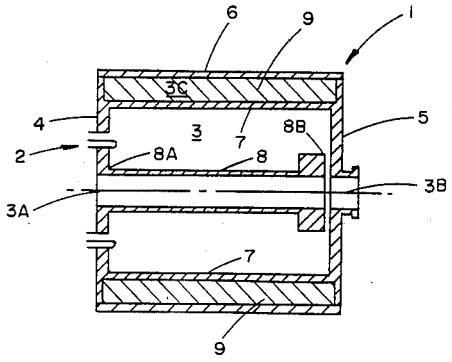
FIG. 2 is a schematic side plan view, in cross section along a vertical diameter of the cavity depicted in FIG. 1, showing the resonant stem of the cavity and mode perturbing rods mounted in one end wall of the cavity according to the invention, but not showing the details of the slotted inner wall or additional perturbing probes, which are depicted in FIG. 3.

The resonant cavity 3 is further provided with a hollow resonant stem 8 of suitable conventional design, which stem has one of its ends 8A mounted on the first end wall coaxially with the cylindrical array of bars 7. The free end 8B of the stem is spaced a desired given distance from the second end wall 5 to define a gap therewith, as best seen in FIGS. 2 and 3. Hollow stem 8 is made to have an inner diameter substantially equal to the diameters of inlet aperture 3A and outlet aperture 3B of cavity 3, as is conventional practice in the design of resonant cavities for beam line applications.

In order to damp any spurious modes that extend through passageways 7′ into the chamber 3C, at least one body of lossy material is disposed in the chamber 3C. In this embodiment, such a body of lossy material 9 is illustrated in FIG. 2 and comprises a body of ferrite that is positioned between the solid outer wall 6 and the array of bars 7 to appropriately damp spurious modes that extend into the spaces 7′ between the bars 7. In other embodiments of the invention, the lossy material can comprise a plurality of tubes, such as the tubes 10 shown in FIG. 8, made of glass, quartz, or other suitable material, and filled with salty water or other well known lossy materials. Further desirable advantages of the tubes 10, or similar tubes, will be explained in greater detail below.

Although the body of ferrite 9 is illustrated in FIG. 2 as only partly filling the chamber 3C, it will be understood that in other embodiments of the invention the body of lossy material 9 can be made to completely fill the chamber 3C. Alternatively, several different bodies of lossy material can be disposed in various desired arrangements around the outer circumference of the cylindrical array of bars 7 to appropriately damp spurious modes that extend into the chamber 3C.

The RF resonance cavity 1 of the invention is further characterized by including a first plurality of rods 11 (see FIGS. 3, 4, & 5), which are each mounted on a respective selected one of the bars 7, for the purpose of perturbing spurious modes that may occur in the resonant cavity 3. Such perturbance is designed to cause the fields of those spurious modes to extend into the lossy material 9 in the chamber 3C where they are damped or substantially attenuated. The rods 11 are arranged at random locations around the circumference of the cylindrical array of bars 7 and the number of rods may vary. It is important to note that the rods need not be specially designed to have a given resonant frequency, in the manner normally required to effectively damp certain identified spurious modes in prior art resonance cavity designs. In order for the present invention to operate effectively, it is only necessary that the rods 11 be made effective to perturb spurious frequencies that occur in the cavity 3, rather than being designed to attenuate those frequencies.

Although the rods 11 can be mounted at random loci on the inner walls of the chamber 3C to effectively perturb spurious modes in the cavity 3, in the preferred embodiment of the invention being described here, the first plurality of rods 11 includes 8 rods that are positioned in pairs at appropriate quadrants around the cylindrical array of bars 7, as shown in FIGS. 3–5 of the drawing. Further details of the preferred dimensions for the spacing of rods 11 in this embodiment of the invention will be explained below. At this point, though, it should be understood that the rods 11 may be positioned at random points anywhere along the lengths of the bars 7, even though they are illustrated here as being arranged in about the one-third of the length of the bars that is most remote from the free end 8B of stem 8. A variety of suitable conventional mounting means may be used to secure the rods 11 in operating position, but in this embodiment of the invention each of the rods 11 is threaded into a suitably tapped hole in the respective bars 7 as shown. With this arrangement, each rod 11 extends through a bar 7 in an orientation generally perpendicular to the bar. Such a mounting arrangement enables the rods 11 to be readily adjusted radially, if desired. Preferably, the rods 7 are fixed in position relative to the bars 7, by being tack welded, or otherwise suitably secured thereto, after any desired radial adjustment of the rods is effected.

Finally, the resonance cavity 1 of the invention includes a second plurality of rods 12, each of which are mounted on the first end wall 4 for still further perturbing all remaining spurious modes in the resonant cavity 3. Such further perturbance enables the lossy material 9 to operate in combination with the first and second plurality of rods 11 and 12 to be effective, in conjunction with the array of bars 7, to eliminate or substantially damp all spurious modes that occur within the resonance cavity 1, without impairing the desired fundamental operating frequency of the cavity. The second plurality of rods 12 may vary in number, but in this form of the invention, it also comprises eight rods, which are mounted at random locations on the inner surface of the first end wall 4 of resonance cavity 1, as seen in FIGS. 3 & 4 of the drawing. The particular dimensions of each of the rods 12 and their preferred relative locations for this embodiment of the invention is explained more fully below.

Now that the structure of the preferred embodiment of the invention has been described, reference is made to FIGS. 6 and 7 to explain the operative characteristics of such a cavity that enable it to eliminate all spurious modes while leaving the fundamental $TM_{o1o}$ mode of the cavity essentially unchanged. Due to the symmetry of the structure of resonance cavity 1, all of the coaxial $TM_{o1m}$ modes have only $H_\phi$ magnetic fields, consequently, only an $i_z$ component of current is caused by these modes to flow on the inside surface of the slotted inner wall of chamber 3C, as defined by spaced bars 7. Accordingly, the slotted inner wall of chamber 3C (bars 7) has no effect on the $TM_{o1m}$ modes, and that wall acts to also completely confine all the fields of these modes to the inner cavity 3. All of the coaxial TE modes have a $H_z$ component of magnetic field, and consequently an $i_\phi$ component of current flowing on the inside surface of the slotted inner cylindrical wall (spaced bars 7). Due to the slits between the bars 7 of this inner wall, the current $i_\phi$ flows around the respective bars and produces an $i_\phi$ current on the outer surface of the bars. Consequently, both the inner cavity 3 and the outer chamber 3C are excited by the TE modes. The lossy material 9 in the chamber 3C is thus effective to damp all of the TE modes. The Stem Modes of the resonance cavity 1 are evanescent tyes of modes associated with the current flowing up and down the stem 8. The fields produced by these Stem Modes radiate away from the stem 8 and decay exponentially. Due to its proximity to the stem, the cylindrical array of spaced bars 7 acts to perturb these Stem Modes, but since the Stem Modes have $E_r$ and $H_\phi$ fields similar to the $TM_{o1m}$ modes they are essentially confined to the inner cavity 3.

In order to suitably attenuate or damp the $TM_{o1m}$ and Stem Modes it is necessary to further perturb, or distort their fields, as mentioned above. Any of the above-mentioned spurious modes that have a radially extended electric field in the vicinity of the first plurality, or group, of radially extended rods 11 will be perturbed by those rods sufficiently to cause them to be damped by the lossy material 9 disposed in the chamber 3C. Measurements on the prototype sample of the preferred embodiment of the invention described herein indicate that all of the $TM_{o1m}$ modes, with the exception of the $TM_{o1o}$ and $TM_{o1l}$ modes were effectively damped up to a frequency of at least 5 $GH_z$. Those two modes were essentially unaffected by the first group of radially disposed perturbing rods 11, since those modes have essentially no radial electric fields ($E_r$)in the vicinity of the rods 11.

FIGS. 6 and 7 show schematicly typical $TM_{n1m}$ electric and magnetic field configurations for the resonance cavity (1). One of the properties of this type of mode is that it has an $E_z$ component of field perpendicular to the end wall 4, as shown by the point and cross arrow symbols in FIG. 7. Further, this mode has a tangential $H_\Phi$ field on the slotted inner wall defined by the spaced bars 7, as shown by the arrows in FIG. 6. Accordingly, the fields of this mode are confined to the inner cavity 3.

In order to suitably damp the $TM_{n1m}$ circumferential modes the second groups of rods 12 mounted on the first end wall 4 are arranged to couple to the normal electric field on that end wall. By staggering the rods 12, as shown, for the preferred embodiment, a desired broad band effect is achieved. These axially oriented perturbing rods 12 are effective to perturb the remaining spurious modes in the cavity 3, thereby causing their fields to excite the chamber 3C where they are damped by the lossy material 9. It will be understood that the first and second plurality of rods 11 and 12 and the lossy material 9 has no effect on the Q of the $TM_{o1o}$ mode. The isolated $TM_{o1l}$ mode is readily damped by coupling a load resistor and double-stub tuner to a conventional loop (not shown) in the cavity 3.

From the foregoing description of the invention, it should be understood that the circumferential modes could also be effectively damped by extending the passageways or slits between the bars 7 so that either one, or both, of the end walls 4 and 5 of the cavity 1 are also provided with radial slots therein. FIG. 8 illustrates an embodiment of the invention that includes that alternative novel feature of the invention. Otherwise, the structural components of the embodiment of the resonance cavity 1 shown in FIG. 8 are essentially the same as those discussed above with reference to the other figures of the of the drawing, except as particularly pointed out below. Thus, a plurality of spaced bars 7 are shown in FIG. 8, arranged in a generally cylindrical array, inward from an outer solid wall 6 to define a chamber 3C therebetween. In order to maintain an hermetic seal around the spaced bars 7 and the slotted first end wall 4 and second end wall 5, the generally cylindrical outer solid wall 6 is extended to have integrally formed end wall portions 6A and 6B, the inner ends of which are sealed, respectively, to the end walls 4 and 5, around the inlet apperature 3A and outlet aperture 3B, as seen in FIG. 8.

A further modification of this embodiment of the invention is the provision of a plurality of Tygon tubes 9A in the chamber 3C around the cavity 3. Each of the tubes 9A is filled with lossy material, such as salty water, to provide a means for damping the spurious modes that extend into the chamber 3C. A still further modification of the invention is that some of the tubes 9A are made to extend to the exterior surfaces of the end walls 6A and 6B so that in suitable applications of the invention all, or a portion, of the tubes 9A can be provided with open ends that expose their interiors to the atmosphere, or to other suitable sources of coolant (not shown) that can be passed through the tubes 9A to provide desired cooling for the lossy material that may be positioned in adjacent tubes, or that may be disposed in the chamber 3C in heat exchange relationship with the tubes 9A. For example, thin film resistors, or a body of ferrite, 9 could be positioned in the chamber 3C around the tubes 9A in heat exchange relationship therewith, in a suitable manner such that the lossy material 9 would be suitably cooled by passage of a coolant through these tubes 9A having their ends open to the exterior of the cavity.

EXAMPLE PROTOTYPE

Now that the characteristic general structural features and operating requirements of the invention have been explained, reference is again made to FIG. 3 where there is illustrated the dimensions for a 90 MHz ($TM_{o1o}$ mode) RF resonance cavity constructed according to the invention. As mentioned above, in order to practice the invention for other desired fundamental frequencies it is only necessary to multiply these illustrated dimensions by the ratio $90(TM_{o1o})/X(TM_{o1o})$, where X equals the new fundamental design frequency that is desired. Thus, for the prototype example of a suitable 90 MHz fundamental frequency RF cavity that is suitable for use as an accelerator in a particle beam line, the outer diameter of the circular end walls 4 and 5 is 20 inches, the diameter of the generally cylindrical array of bars 7 is 16 inches, the maximum outer diameter of the stem 8 is 7 inches at its free end 8B, and $\frac{3}{4}$ inches on the outside diameter of its fixed end. The thin wall portion of the stem 8 is 17 inches in length and the gap defined between the free end 8B of the stem 8 and the second end wall 5 is $\frac{1}{2}$ inch in length. The axial length of the cavity 1 between the inner surfaces of the end walls 4 and 5 is 20 inches, which is also the length of each of the conductive bars 7. As mentioned above, in this embodiment of the invention, the bars 7 are each 1 inch wide and have a spacing between them comprising the passageways or slits 7′ prime that is 1/16 inch wide.

The first group of radially disposed rods 11 is made of rods that are each $\frac{3}{8}$″ in diameter and about 2″ in length. Four pairs of the rods are disposed at 90° from one another, as shown, with a first axially innermost ring of rods spaced about 6 inches from the first end wall 4, and with a second ring of rods spaced about 4 inches from that end wall. As best seen in FIG. 5, the rods in each pair of rods in the first plurality or group of rods are accurately spaced from one another by about 2 inches. Finally, the second plurality, or group, of rods 12, in which the rod is axially disposed on the inner surface of the first end wall 4, and is each made about 1 inch long is arranged with the rods positioned with about equal spacing between the pairs of axially extended rods 12, as best seen in FIG. 4. It does not appear that there is a rigid set rule for determining the respective positions or the number of radial extending rods 12 that should be used in practicing a given selected embodiment of the invention. And, as pointed out above with reference to FIG. 8, it is possible to damp the circumferential modes by providing slots in the end walls 4 and 5, or in at least in one of the end walls 4 or 5, which slots would be extensions of the slits or passageways between the cylindrically arrayed bars 7. Thus, in some applications of the invention it may be possible to eliminate the second plurality of spurious mode perturbing rods 12.

From the foregoing description of the invention and the accompanying illustrations of its embodiments in the drawings, it will be apparent to those skilled in the art that various further modifications and improvements of the invention may be made without departing from the scope of the invention. Accordingly, it is my intention to encompass within the following claims the true spirit and limits of the invention.

I claim:

1. A radio frequency resonance cavity that supports a fundamental resonant frequency and that is free of spurious modes, comprising, wall means defining a resonant cavity having inlet and outlet apertures and further defining a chamber around a predetermined portion of said resonant cavity, said wall means still further defining passageways through the radially inner wall of said chamber for enabling spurious modes to extend from the cavity through the passageways and into the chamber, lossy material disposed in said chamber for damping said spurious modes, and a plurality of rods mounted at random loci on the inner walls of said cavity thereby to dispose the rods to extend into the cavity where they perturb all remaining spurious modes and cause there fields to excite said chamber and be damped therein by said lossy material, whereby electro-magnetic energy having a fundamental resonant frequency equal to that of the cavity can enter the cavity through said inlet aperture and leave the cavity through said oulet aperture without being substantially affected by spurious modes.

2. An invention as defined in claim 1 wherein said cavity is generally cylindrical in configuration, and wherein said chamber surrounds the generally cylindrical side walls of the resonant cavity and at least one of the end walls of said resonant cavity.

3. An invention as defined in claim 2 wherein said passageways comprise slits that each extend substantially the entire length of said radially inner side of the chamber and that are generally parallel to the longitudinal cavity axis extending between the inlet and outlet apertures thereof.

4. An invention as defined in claim 3 wherein said lossy material comprises a plurality of closed tubes each filled with salty water, and further including a plurality of open-ended hollow tubes mounted in said chamber in heat exchange relationship with the lossy material in said closed tubes, with the interior of at least some of said open-ended tubes in communication with the exterior of said chamber, whereby coolant is circulated from the exterior of the chamber through said at least some of said tubes thereby to cool the lossy material disposed in heat exchange relationship with said open-ended tubes.

5. An invention as defined in claim 3 wherein said plurality of rods includes a first group of rods each of which is mounted at a predetermined point on said inner wall of the chamber, between two of said slits, and further includes a second group of rods each mounted on one of said end walls and spaced from the inner side of said chamber by a predetermined distance.

6. An invention as defined in claim 1 wherein said cavity is generally cylindrical in configuration and has a first solid end wall and a second solid end wall each of said solid end walls being hermatically sealed to a solid outer cylindrical wall, and wherein said chamber has its outer surface defined by said solid end walls and the solid outer wall and is further defined by a first slotted end wall and a second slotted end wall each disposed, respectively, axially inward from said first and second solid end walls and connected together by a plurality of spaced bars arranged in a generally cylindrical array between the slotted end walls thereby to align the passageways or slits between the bars of said array with the slots in the slotted end walls, whereby said chamber is made to extend around the generally cylindrical array of bars and around the exterior sides of both of the slotted end walls.

7. An invention as defined in claim 6 wherein the width of each of said slits is substantially equal to the width of each of the other slits between adjacent bars, and wherein the width of each slit is about 1/16 of the width of one of said bars defining the radially inner side of the chamber.

8. An invention as defined in claim 6 including a hollow stem mounted with its longitudinal axis in alignment with said inlet and outlet apertures and disposed with a first end of the stem fastened to the first end wall of the cavity around the inlet aperture therethrough, the other end of said stem being free to vibrate and defining a gap between it and the adjacent second end wall of the cavity.

9. A radio frequency resonance cavity that has a fundamental resonant frequency and that is free of spurious modes, comprising, a cylinder defined by first and second generally circular end walls each having wall means defining an aperture through and coaxial with its center, a cylindrically shaped solid outer wall each axial end of which is connected, respectively, to one of said circular end walls adjacent to the periphery thereof, and a plurality of bars arranged in a generally cylindrical array with their opposite ends each, respectively, spaced from immediately adjacent bars and secured to one of said circular end walls at a preselected point thereon between the circumference of the end wall and its center, said cavity further comprising a hollow resonant stem having one of its ends mounted on said first end wall coaxially with said cylindrical array of bars and having its free end spaced a given distance from said second end wall to define a gap therewith, at least one body of lossy material disposed between said outer wall and the array of bars to damp spurious modes that extend into the spaces between the bars, a first plurality of rods each mounted on a respective selected one of said bars for perturbing spurious modes to cause their fields to extend into the lossy material and be damped by it, and a second plurality of rods each mounted on said first end wall for perturbing essentially all remaining spurious modes to enable said lossy material and said first and second plurality of rods to be effective in combination with said array of bars to eliminate or substantially damp all spurious modes without damping the fundamental resonant frequency of the cavity.

10. An invention as defined in claim 9 wherein said body of lossy material is disposed around at least a portion of the outer circumferential surface of said cylindrical array of bars.

11. An invention as defined in claim 10 wherein said first plurality of rods is mounted on said generally cylindrically arrayed bars to extend through them and be disposed generally perpendicular to the bars, thereby to protrude radially into the resonant cavity.

12. An invention as defined in claim 11 wherein said first and second end walls are slotted to extend the slits between the bars of the generally cylindrical array of bars, into said end walls, and including a first and second solid end wall disposed axially outward, respectively, from the slotted end walls and hermetically sealed to the solid outer cylindrical wall, thereby to define a hermetic seal around the exterior of the slotted end walls and the generally cylindrical array of bars disposed therebetween.

* * * * *